United States Patent [19]

Sudre

[11] 4,005,925

[45] Feb. 1, 1977

[54] MULTIPLE CONNECTOR

[75] Inventor: Jean-Louis Sudre, Cluses, France

[73] Assignee: Etablissements Carpano & Pons S.A., France

[22] Filed: Feb. 18, 1975

[21] Appl. No.: 550,593

[30] Foreign Application Priority Data

Mar. 1, 1974 France ..... 74.08411

[52] U.S. Cl. ..... 339/198 H

[51] Int. Cl.² ..... H01R 13/40

[58] Field of Search ..... 339/198 R, 198 G, 198 H, 339/91 R, 210 R, 210 M, 206 R, 206 P, 207 R

[56] References Cited

UNITED STATES PATENTS

| | | | |
|---|---|---|---|
| 3,831,133 | 8/1974 | Grundfest | 339/210 M |
| 3,848,951 | 11/1974 | Michaels | 339/198 H |

*Primary Examiner*—Joseph H. McGlynn
*Attorney, Agent, or Firm*—Robert E. Burns; Emmanuel J. Lobato; Bruce L. Adams

[57] ABSTRACT

A multiple connector comprises a stack of slidably interconnected modular housing sections of insulating material each containing several electrical connectors. Each housing section has a first stop cooperating with a second stop of an adjacent section to allow relative sliding of the sections between a piled position for connection of all the connectors with complementary connectors of a washing machine programmer for example, and a stepped position defined by coaction of said first and second stops and in which one section may remain in its piled connection position and the adjacent slid section is displaced by an amount sufficient to ensure disconnection of the connectors therein from the corresponding complementary connectors. Preferably, each connector slides in its housing section between disconnected and connected positions in response to sliding of the adjacent housing section between its stepped and piled positions.

3 Claims, 11 Drawing Figures

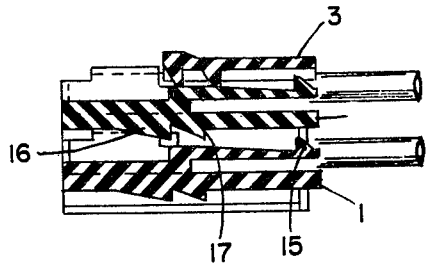
FIG 8
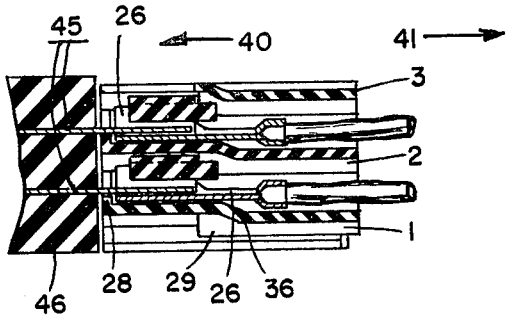
FIG 9
FIG 11
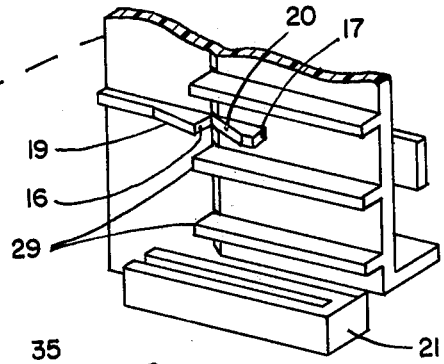
FIG 10
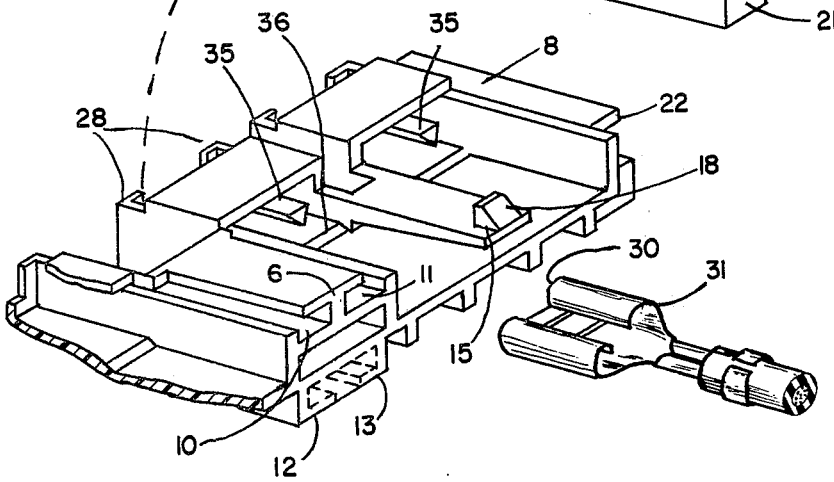

MULTIPLE CONNECTOR

The invention concerns multiple connectors of the type comprising juxtaposed modular housing sections of insulating material each containing at least one electrical connector, each housing section being slidably interconnected with the adjacent housing section(s) for relative sliding movement along a direction for connection and disconnection of the connectors therein.

Such a connector is described, for example, in French Patent No. 1,592,943, in which a stack of housing sections provides a jack strip in which several jacks are held side-by-side. Stops are provided to hold the modular housing sections in an aligned position.

In another multiple connector of this type, described in French Patent No. 2,191,306, a male pin and a female plug are formed by nested concentric elements staggered in relation to one another. Once in place, the elements are fixed relative to one another. When the male pin and female plug are connected or disconnected, all of the contacts are plugged in or separated simultaneously, which may require a large force when the number of contacts is great, especially when the contacts have a tight fit.

Hence, for example, in a washing machine, certain leads for supplying a heating resistor or a washing motor must be able to accept a high current load, of the order of 16A at 220V. This implies that the connexion plugs of these leads must have a relatively large cross-section of a conducting metal to be able to accept such a current load, and the application pressure between the corresponding pins/plugs must also be high, i.e. there must be a tight fit. Because of this tight fit, it is necessary to exert a great force along the axial direction of the plug/pin assembly to connect or disconnect it. Consequently, if the number of plug assemblies each having a high application pressure is multiplied, the multiple connector cannot easily be connected or disconnected by hand, as the force required is excessive.

This problem is already known to washing machine manufacturers. In known arrangements, the end of each lead which must be connected to a programmer carries an individual connection pin and the pins are connected one by one, appropriate insulation being provided either individually on each pin, or on the programmer. The connection of each pin is often hindered by the fact that it must be carried out inside the machine in a location to which access is difficult, and incorrect connections of pins may take place accidentally, and thus cause faulty operation of the machine. This has led some manufacturers to connect all of the leads to the programmer prior to insertion and securing the latter, but this insertion is then made more difficult. Moreover, whenever repair or maintenance has to be carried out, the same difficulties arise if some of the plug assemblies must be disconnected; it may not be possible to remove and replace the programmer carrying its entire set of leads without dismantling the machine. Also, the individual disconnection and reconnection of several plug assemblies involves a risk of error, even for a skilled mechanic, since he may not have a full knowledge of the particular make of machine.

An object of the invention is to provide a multiple connector of the specified type which enables the stated drawbacks to be overcome and offers a solution to the problem of connection, particularly in the case where a fairly considerable force is required for connecting or disconnecting each single plug assembly.

According to the invention, a multiple connector comprises a plurality of modular housing sections of insulating material each containing at least one electrical connector, each housing section including first means cooperating with complementary second means of an adjacent housing section to slidably interconnect the housing sections for relative sliding movement along a direction for connection and disconnection of the connectors therein with complementary connectors disposed in a corresponding array. Each housing section further comprising a first stop cooperating with a second stop of an adjacent section to allow relative sliding of the sections between a first position of all the sections for simultaneous connection of all the connectors therein with said complementary connectors and a second position defined by coaction of said first and second stops and in which one section may remain in its first connection position and an adjacent section is displaced relative to said one section by an amount sufficient to ensure disconnection of the connector(s) therein from the corresponding complementary connector(s).

Such a multiple connector enables rapid and easy connection and disconnection of a large number of male or female conductors and the complementary female or male conductors of a programmer for example, by a manual actuation involving a fairly moderate force, and without a possibility of incorrect connection.

Each of said connectors may be disposed in a housing section for movement of the connector relative to the housing section along said direction between a first position for connection with a complementary conductor and a second position for disconnection with a complementary conductor, each housing section further comprising means coacting with the conductor in an adjacent housing section whereby the connector in said one housing section in said first position is moved between its second and first positions in response to sliding of an adjacent housing section between its second and first positions. Also, each housing may include a third stop cooperating with a complementary stop on an adjacent housing section to allow relative sliding movement of adjacent housing sections to a third position in which conductors can be inserted in and removed from one of said adjacent housing sections.

The accompanying drawings show, by way of example, and embodiment of a multiple connector according to the invention. In the drawings:

FIG. 8 is a cross-section similar to FIG. 6, but with the housing sections in a third "connection" position;

FIG. 9 is a cross-section similar to FIG. 5, with the housing sections in said third position and their conductors connected to complementary conductors of a programmer;

FIG. 10 is a perspective view of part of one of the insulating housing sections and a conductor; and FIG. 11 is a perspective view of part of an under face of an insulating housing section adapted to be slidably mounted on the housing section of FIG. 10, the former housing section being shown turned by 90° in the clockwise direction from the position if occupies when mounted on the housing section of FIG. 10.

Figure 1:
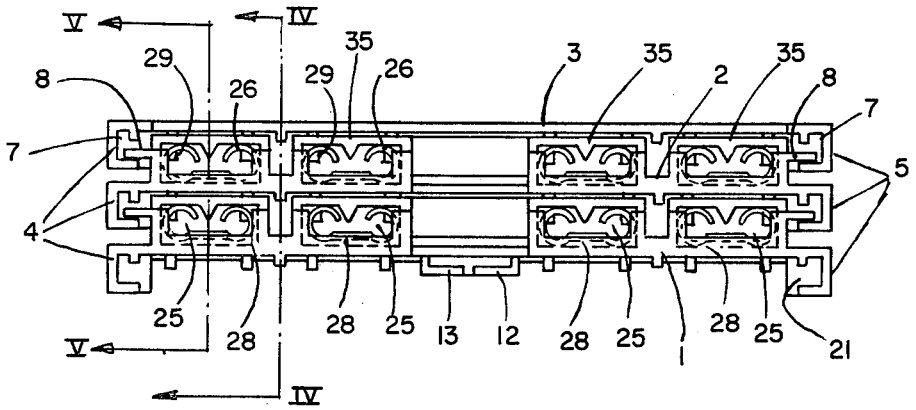
FIG. 1 is an elevational view (seen from below FIG. 2) of a multiple connector.
Figure 2:
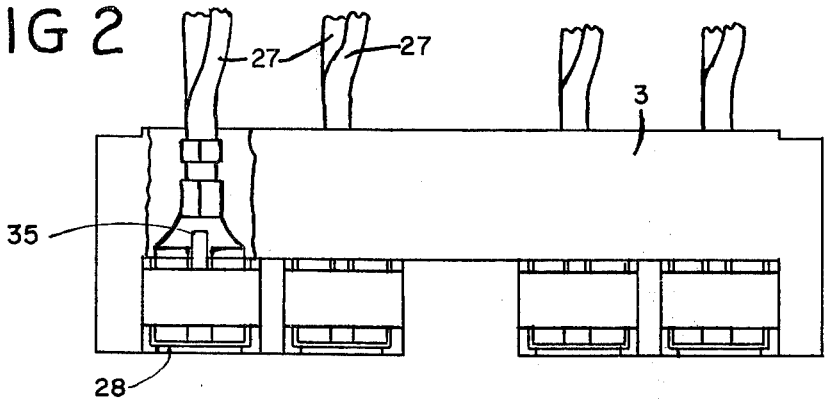
FIG. 2 is a plan view of the multiple connector, with its cover partly cut away.
Figure 3:
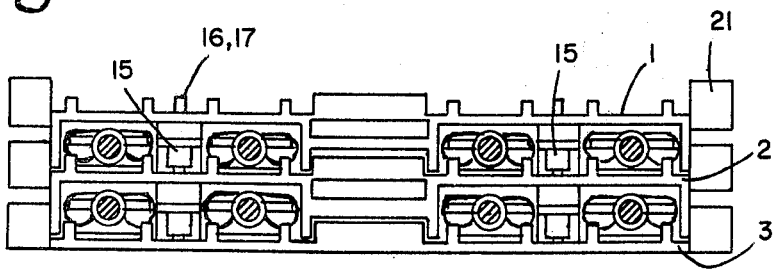
FIG. 3 is an elevational view of the multiple connector, looking from above FIG. 2.

As shown in FIGS. 1 to 3, the multiple connector includes two identical insulating housing sections 1 and 2, and an insulating cover 3. These housing sections are stacked and comprise means for slidably interconnecting them together, in the form of slides 4 and 5 on each of sections 1 and 2 as well as on cover 3, and a complementary slide 6 (FIG. 10) provided along only a part of the length of sections 1 and 2. The slides 4 and 5 are dimensioned to receive, in an inner part 7 thereof, a lateral flange 8 on each of the sections, the flanges 8 of one housing section being able to slide in the inner parts 7 of slides 4 and 5 of the adjacent section. The slide 6 (FIG. 10) of each section is dimensioned to receive, in inner parts 10 and 11 thereof, flanges 12 and 13 provided on each of elements 1 and 2 and on cover 3, the flanges 12 and 13 of one section being able to slide in the respective inner parts 10 and 11 of the slide 6 of the adjacent section.

Figure 4:
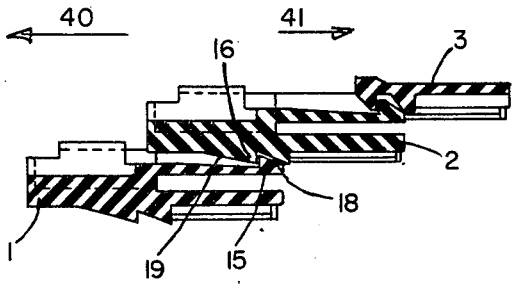
FIG. 4 is a cross-section taken along line IV—IV of FIG. 1, with complementary stops holding two housing sections in a first position, and prior to the insertion of conductors therein.
Figure 5:
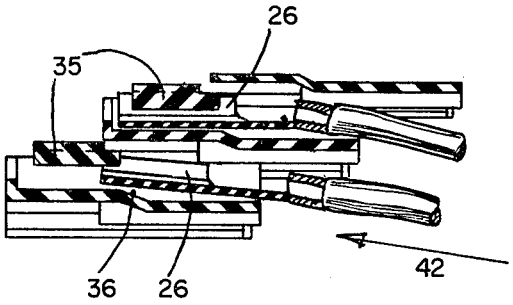
FIG. 5 is a cross-section taken along line V—V of FIG. 1, with the housing sections in the same first position as in FIG. 4, after insertion of conductors.
Figure 6:
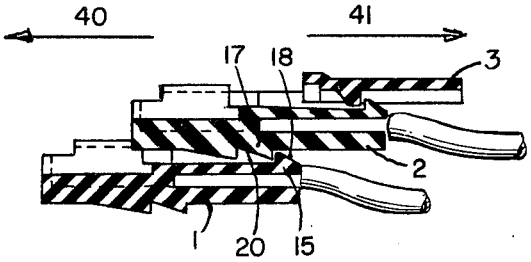
FIG. 6 is a cross-section taken along line VI—VI of FIG. 1, with complementary stops holding the two housing sections in a second position.
Figure 7:
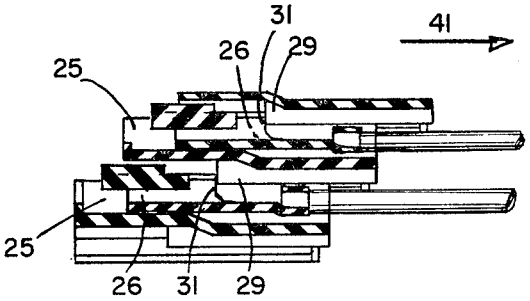
FIG. 7 is a cross-section similar to FIG. 5, but with the housing sections in the second position of FIG. 6.

Means are provided for limiting the relative sliding of the two adjacent sections in a first direction. As shown in FIGS. 10 and 11, a stop 15 (FIG. 10) is provided on one of the sections and two stops 16 and 17 (FIG. 11), disposed in the trajectory of stop 15, are provided on the adjacent section. Two rows of stops are thus provided for example on each insulating section (FIGS. 1 to 3). Stops 16 and 17 determine, with stop 15, two relative positions of the adjacent sections. A first position, with the sections staggered in step formation, is shown in FIGS. 4 and 5. A second stepped position is shown in FIGS. 6 and 7. Inclined planes 18, 19 and 20 are provided adjacent each of the three stops 15, 16 and 17 to facilitate intial engagement of the stop 15 successively with stops 16 and 17.

Relative movement of the two adjacent elements is also limited, in the direction opposite said first direction, by an end wall 21 located at an end of each of slides 4 and 5. These walls 21 serve as abutments for the ends 22 (FIG. 10) of flanges 8 cooperating with slides 4 and 5.

In the example shown, each of the insulating housing sections has four housings 25, in each of which is disposed a plug 26, female for example, crimped on a conducting lead 27 for connection to an element of a washing machine, for example, Each housing 25 is of sufficiently large dimensions to receive a plug 26 with a slight play. In the position of FIG. 9, axial movement of each plug 26 is prevented on the one hand by a wall 28 provided on the section including the housing 25, and on the other hand by ends 29 of two ribs on the adjacent insulating section. The walls 28 are also visible on FIG. 10 and the ends 29 on FIG. 11. Ends 30 and 31 (FIG. 10) of each plug 26 are thus held respectively between a wall 28 and two ends 29. A rib 35 is provided in each housing 25 to prevent a plug 26 from being mounted upside-down. An inclined plane 36, disposed substantially in the middle of each housing 25, facilitates the insertion of each plug 26 in its housing 25.

The means for axially retaining each plug could alternatively be provided integral with one and the same insulating housing section, or each plug could even be moulded into the housing section containing it.

The described multiple connector is assembled and used as follows. As a function of the number of male pins provided, on a washing machine programmer for example, a given number of corresponding insulating housing sections (two, 1 and 2 in the described example) and a cover 3 are assembled by introducing the flanges 8 of one of the slides 4 and 5 into the other and simultaneously the flanges 12 and 13 of one in the slide 6 of the other.

As shown in FIG. 4, the insulating section 2 is then moved according to arrow 40 in relation to section 1 until the inclined plane 19 of section 2 comes into contact with the inclined plane 18 of stop 15. These inclined planes are mutually pushed apart, one up and the other down, this being made possible by the resilience of the material of each housing section. The stops 15 and 16 then arrive in the position of FIG. 4 where stop 15 is diposed facing stop 16 and prevents removal of the section 2 from section 1 along the direction of arrow 41. The cover 3 is placed on section 2 in the same way.

As shown in FIG. 5, the plugs 26 are then introduced, as indicated by arrow 42, in their respective housings 25, the ribs 36 preventing introduction of the plugs 26 upside-down. The inclined planes 36 facilitate this insertion. The plugs 26 could have other shapes than that shown, and the housing 25 appropriate dimensions to receive them.

As shown in FIG. 6, the insulating section 2 is then moved according to arrow 40 relative to section 1 until the inclined plane 20 of section 2 comes to contact the inclined plane 18 on which it slides. The stops 17 and 15 then come to the position of FIG. 6 where stop 15 is disposed facing stop 17 and prevents return movement (i.e. according to arrow 41) of section 2 in relation to section 1. The cover 3 is positioned on section 2 in the same way.

In this relative position of the insulating housing sections, as shown in FIG. 7, the plugs 26 are held in their respective housing 25; they can no longer be withdrawn in the direction of arrow 41 since the part 31 of each plug is retained by the rib ends 29. The plugs cannot hencefath be lost or inadvertently inverted, so that errors of connection can be avoided. The multiple connector is now ready to be connected to the programmer.

To carry out this connection, as shown in FIG. 9, the section 1 is firstly placed bearing against programmer 46, then section 2 is moved in relation to section 1 along the direction of arrow 40 so that section 2, by the ends 29 of its ribs, also pushes the plugs 26 disposed in housings 25 of section 1 in the direction of arrow 40. When these plugs are fully pushed in, the section 2 is aligned with section 1. The stop 15 of section 2 and the stop 17 of the upper adjacent element (in this case, the cover 3) are positioned so that the plugs 26 of section 2 are not yet in contact with the male pins 45 although the section 2 is fully pushed up against the programmer. A movement according to arrow 40 of the cover 3 produces movement in the same direction of the plugs 26 of section 2 in the corresponding housings and their introduction onto the corresponding facing male pins 45.

If the connector has more than two insulating housing sections, each of the sections is successively connected in the same manner by sliding onto the previously connected section. The connected multiple connector is finally in the position shown in FIGS. 8 and 9. It is observed that in this position, the plugs 26 are held in their housings 25 with practically no axial play, their ends 30 and 31 (FIG. 10) being respectively held on the one hand by the walls 28 and on the other hand by the rib ends 29.

To disconnect this multiple connector, it suffices to adopt the reverse procedure. Section 2 is disconnected by sliding section 2 relative to section 1 (arrow 41) until its stop 17 comes to abut with stop 15 of section 1 (FIG. 6). The section 1 is then disconnected in turn.

As a variation, it would be possible to provide a connector in which, for example, the upper insulating housing section is connected first, or in which an intermediate one of the stack of housing sections is connected first, the adjacent upper and lower sections being successively connected in turn.

Also, the section 2 could have a single stop able to cooperate with the stop 15 of section 1, without a stop 16; operation of the connector would be substantially the same, only the position shown in FIGS. 4 and 5 would not be provided for.

In another embodiment, the juxtaposed insulating housing sections may be disposed coaxially, certain of the means for joining one insulating section to an adjacent element being formed by the profile of the section themselves, the outer part of one element telescoping in the inner part of the adjacent element. These insulating sections could for example, be of polygonal cross-section such as square, rectangular, or hexagonal, or circular in which case the insulating sections are disposed concentrically. In each case, the insulating housing sections able to slide in one another are adapted to be successively connected for example starting with the central insulating section which may contain a small number of plugs involving a high unitary connection and disconnection force, the sections disposed coaxially about the first carrying a greater number of plugs each involving a smaller unitary connection and disconnection force.

This embodiment will, as the previously described embodiment, include cooperating stop means for defining at least one staggered position of the adjacent pairs of sections.

Hence, the multiple connector according to the invention enables rapid and easy connection and disconnection of a large number of plug units without any possible error of inversion of the plug. It is particularly useful in the case when a great force is required to connect or disconnect a signal plug unit.

The multiple connector according to the invention is especially useful in applications where the force required to simultaneously connect or disconnect all of the plug units of the connector would be too great to be carried out manually. A particularly interesting application of such a connector is the connection of a set of conducting leads to a programmer, for example of a washing machine or another automatic apparatus.

What is claimed is:

1. A multiple connector comprising a plurality of modular housing sections of insulating material and each containing at least one electrical connector, each housing section including first means cooperating with complementary second means of an adjacent housing section for slidably interconnecting the housing sections for relative sliding movement along a direction for connection and disconnection of the connectors therein with complementary connectors disposed in a corresponding array, each housing section further comprising a first stop and a second stop, the first stop being positioned relative to and cooperating with the second stop of an adjacent section to allow relative sliding of the sections between a first position with all the sections positioned for simultaneous connection of all the connectors therein with said array of complementary connectors and a second position defined by contacting coaction of said first and second stops at which one housing section remains at its first connection position and an adjacent section is displaced relative to said one housing section by an amount sufficient to ensure disconnection of the at least one connector therein from the array of corresponding complementary connectors.

2. A multiple connector according to claim 1, in which each of said electrical connectors is disposed in a housing section for movement of the connector relative to the housing section along said direction between the first position for connection with a complementary conductor and the second position for disconnection with a complementary conductor, each housing section further comprising means coacting with the connector in an adjacent housing section for displacing the connector from its second to its first position when the housing section adjacent the connector is displaced between its second and first positions, whereby the connector in said housing section in said first position is moved between its second and first position in response to sliding of an adjacent housing section between its second and first positions.

3. A multiple connector according to claim 1, in which each housing section includes a third stop cooperative with and positioned relative to said first stop on an adjacent housing section to allow relative sliding movement of adjacent housing sections to a third position at which said means coacting with the connectors in the adjacent housing sections are positioned remote and disengaged from the connectors, whereby conductors can be inserted in and removed from ones of said adjacent housing sections.

* * * * *